US007419065B2

(12) United States Patent
Sommerfeld et al.

(10) Patent No.: US 7,419,065 B2
(45) Date of Patent: Sep. 2, 2008

(54) LIGHT WEIGHT HIGH CAPACITY FRICTION DRAFT GEAR ASSEMBLY

(75) Inventors: Howard Sommerfeld, Oak Forest, IL (US); Wajih Kanjo, Lockport, IL (US)

(73) Assignee: Wabtec Holding Corp., Wilmerding, PA (US)

( * ) Notice: Subject to any disclaimer, the term of this patent is extended or adjusted under 35 U.S.C. 154(b) by 364 days.

(21) Appl. No.: 11/366,923

(22) Filed: Mar. 2, 2006

(65) Prior Publication Data

US 2007/0205174 A1 Sep. 6, 2007

(51) Int. Cl.
*B61G 9/00* (2006.01)

(52) U.S. Cl. ..... 213/32 C; 213/33

(58) Field of Classification Search ..... 213/31, 213/32 C, 32 R, 33, 34, 36
See application file for complete search history.

(56) References Cited

U.S. PATENT DOCUMENTS 1,914,479 A 6/1933 Brooks
2,701,063 A * 2/1955 Tucker ..... 213/31
2,768,755 A 10/1956 Cottrell
3,581,909 A 6/1971 Peterson
4,645,187 A * 2/1987 Kanjo et al. ..... 213/33
5,152,409 A 10/1992 Sommerfeld
5,443,170 A * 8/1995 Merke et al. ..... 213/32 C
5,452,814 A * 9/1995 Merker et al. ..... 213/32 C
5,495,957 A * 3/1996 Merker et al. ..... 213/32 C
5,529,194 A * 6/1996 Merker et al. ..... 213/32 C
6,923,331 B2 * 8/2005 Sommerfeld ..... 213/32 C
7,311,215 B2 * 12/2007 Sommerfeld ..... 213/32 C

* cited by examiner

*Primary Examiner*—Lars A Olson
(74) *Attorney, Agent, or Firm*—James Ray & Assoc.

(57) ABSTRACT

A light weight high capacity friction-type draft gear assembly includes a housing having a front and a rear portion. A compressible cushioning element is positioned within the rear portion with a seating arrangement abutting one end thereof. A friction cushioning element is provided in the front portion of the housing and a spring release mechanism is provided for continuously urging the friction cushioning element outwardly from the compressible cushioning element thereby releasing such friction cushioning element after compression of such draft gear assembly.

20 Claims, 3 Drawing Sheets

LIGHT WEIGHT HIGH CAPACITY FRICTION DRAFT GEAR ASSEMBLY

CROSS-REFERENCE TO RELATED APPLICATIONS

This application is closely related to U.S. Pat. No. 5,152,409 issued on Oct. 6, 1992 and entitled "Draft Gear Assembly". The teachings of U.S. Pat. No. 5,152,409 are incorporated herein by reference thereto.

FIELD OF THE INVENTION

The present invention relates, in general, to friction-type draft gear assemblies used on railway cars to provide slack and to absorb shock loads encountered by such railway cars and, more particularly, this invention relates to a housing and friction clutch mechanism for use in a draft gear assembly having a lighter weight and which is capable of meeting AAR-M-901G performance specifications.

BACKGROUND OF THE INVENTION

Draft gear assemblies which utilize friction-type clutch mechanisms to absorb heat energy generated during service have been in widespread use on railway cars for several years prior to the present invention, as is generally well known in the railway art. These draft gear assemblies are disposed within an elongated opening located in the center sill member of the railway car along the longitudinal axis thereof and behind the shank, or innermost end, of the railway car's coupling mechanism.

In this position, these friction clutch type draft gear assemblies will absorb at least a relatively large portion of both the buff and draft forces generated during service. Such buff and draft forces encountered by such railway car are usually being applied in an alternating manner to the center sill member during normal car operation on the track.

Many of such prior art type friction clutch draft gear assemblies are taught in U.S. Pat. Nos. 2,916,163; 3,178,036; 3,447,693; 4,645,187; and 5,152,409. Each of the above-identified patents is owned by the assignee of the present invention. The teachings of each of these patents are also all incorporated into the present application by reference thereto.

It is quite well recognized, by those persons who are skilled in the art of friction clutch type draft gear assembly design, that there are a number of significant reasons why lighter weight draft gear assemblies are desirable in the railroad industry. The first reason is that less energy is required to move the railway car over the track structure. A second reason is that additional pay load may be carried by such car without exceeding a load limit on a particular track structure and without incurring increased energy costs. A third reason is that railroads are continuously attempting to increase load carrying capacity of modern railway cars.

Nevertheless, regardless of the weight of such draft gear assembly, it must be capable of maintaining the minimum shock absorbing capacity during its service life. This minimum shock absorbing capacity is specified in the standards which have been established by the Association of American Railroads (AAR), particularly, AAR specification M-901G. This specification, for example, requires that these draft gear assemblies have a rated capacity of at least 36,000 foot pounds and a rated velocity of at least 5 MPH. Also, it is important to note that the shock absorption must be accomplished without exceeding a 500,000 pound peak reaction force applied to the coupler of the railway car.

However, even though a light weight design of the draft gear assembly taught in U.S. Pat. No. 5,152,409 has been successfully used in railway applications, it has not been found adequate to meet AAR-M-901G specification requirements.

OBJECTS OF THE INVENTION

It is, therefore, one of the primary objects of the present invention to provide a friction-type draft gear assembly which will at least meet the AAR-M-901G standard while at the same time exhibiting a lighter weight than prior art draft gear assemblies.

Another object of the present invention is to provide a friction-type draft gear assembly having improved lubricity in the friction portion of such draft gear assembly.

Still another object of the present invention is to provide a friction-type draft gear assembly which will not require any modification to present railway rolling stock for installation.

Yet another object of the present invention is to provide a friction-type draft gear assembly which will reduce energy requirements.

A further object of the present invention to provide a friction-type draft gear assembly that is less susceptible to undesirable environmental conditions that will be encountered during use of such friction-type draft gear assembly.

In addition to the objects and advantages listed above, various other objects and advantages of the friction clutch mechanism of the draft gear assembly disclosed herein will become more readily apparent to persons skilled in the relevant art from a reading of the detailed description section of this document, particularly, when the detailed description is taken in with the attached drawings and the appended claims.

SUMMARY OF THE INVENTION

The present invention provides a railway car friction-type draft gear assembly to absorb buff and draft shocks that are usually encountered in such railway car rolling stock during a coupling operation of such railway car to a train consist and during normal operation of such train consist on a track structure. The draft gear assembly includes a housing member, having a predetermined length, that is closed at a first end thereof by an end wall. The housing member is open at an axially opposed second end thereof. Such housing member has a rear portion adjacent the first end and a front portion adjacent such axially opposed second end. The front portion is in open communication with such rear portion and has a pair of laterally spaced and axially opposed inner friction surfaces having a predetermined Brinell hardness. A compressible cushioning element is centrally disposed within such rear portion of the housing member. One end of such cushioning element engages at least a portion of an inner surface of the end wall closing such first end of the housing member. This compressible cushioning element extends longitudinally from such inner surface of such end wall. A positioning means is provided adjacent the inner surface of such end wall at the first end of the housing member. This positioning means centrally maintains such one end of the compressible cushioning element in the rear portion of the housing member during compression and extension of such compressible cushioning element. A seat means is provided which has at least a portion of one surface thereof engaged with an axially opposed end of such compressible cushioning element. Such seat means is mounted to move longitudinally within such housing member for respectively compressing and releasing such compressible cushioning element during application and release of a force exerted on such draft gear assembly. A friction cushioning means is positioned at least partially within the front portion of such housing member. The friction cushioning means absorbs energy during a compression of such draft gear assembly. This friction cushioning means includes a pair of laterally spaced movable plate members of substantially uniform thickness. Each movable plate member has an outer friction surface and an inner friction surface and at least one substantially flat edge disposed intermediate such outer friction surface and such inner friction surface. Such one edge is disposed for engagement with such seat means. At least a portion of such outer friction surface of the movable plate member movably and frictionally engages a respective inner friction surface of such front portion of the housing member. Each of the movable plate members has a length of between about 7.84 inches and about 8.93 inches. The friction cushioning element also includes a pair of laterally spaced tapered plate members which have an outer friction surface and an inner friction surface. Such outer friction surface of each such tapered plate member movably and frictionally engages at least a portion of the inner friction surface of a respective one of such movable plate members. A pair of laterally spaced wedge shoe members is provided in such friction cushioning means. Such wedge shoe members have at least a portion of an outer friction surface that movably and frictionally engages at least a portion of an inner friction surface of a respective one of such tapered plate members. Each wedge shoe member has at least a portion of one edge thereof which engages such seat means. Further, such pair of wedge shoe members include a portion on an opposed edge thereof having a predetermined taper. The friction cushioning means also includes a center wedge member having a pair of matching predetermined tapered portions which engage such tapered portion of a respective one of such wedge shoe members. The center wedge member initiates frictional engagement of such friction cushioning means and thereby absorbs energy. Finally, such friction cushioning means includes four lubricating means for lubricating at least four predetermined friction surfaces selected from such inner friction surface of such movable plate members, such outer friction surface of such tapered plate members, such inner friction surface of such tapered plate members and the outer friction surface of such wedge shoe members. The draft gear assembly further includes a spring release means engaging and longitudinally extending between the seat means and the center wedge member. Such spring release means continuously urges such friction cushioning means outwardly from the compressible cushioning means to release such friction cushioning element when an applied force compressing such draft gear assembly is removed.

DETAILED DESCRIPTION OF THE INVENTION

Figure 1:
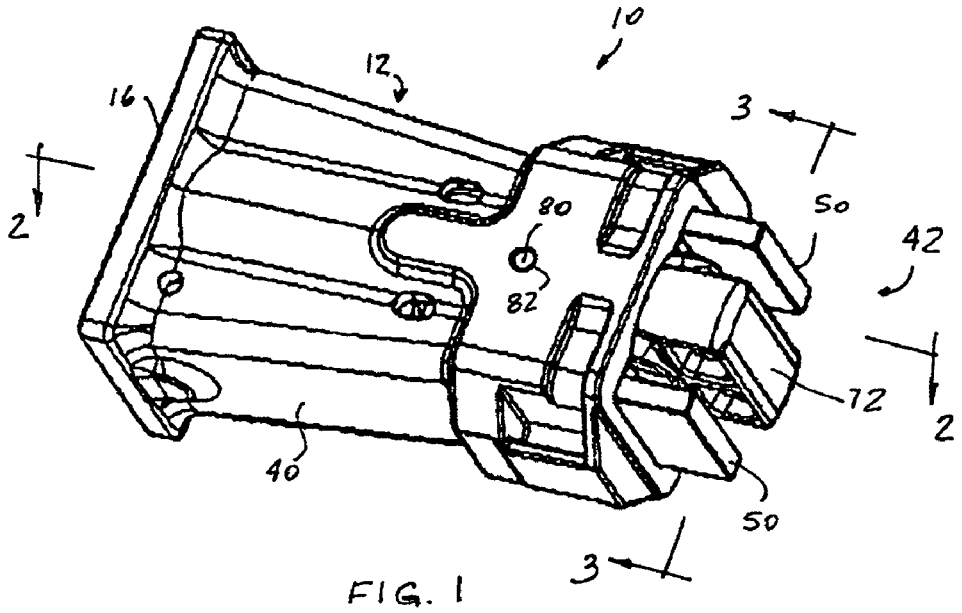
FIG. 1 is an isometric view of the friction-type draft gear assembly of the present invention.
Figure 2:
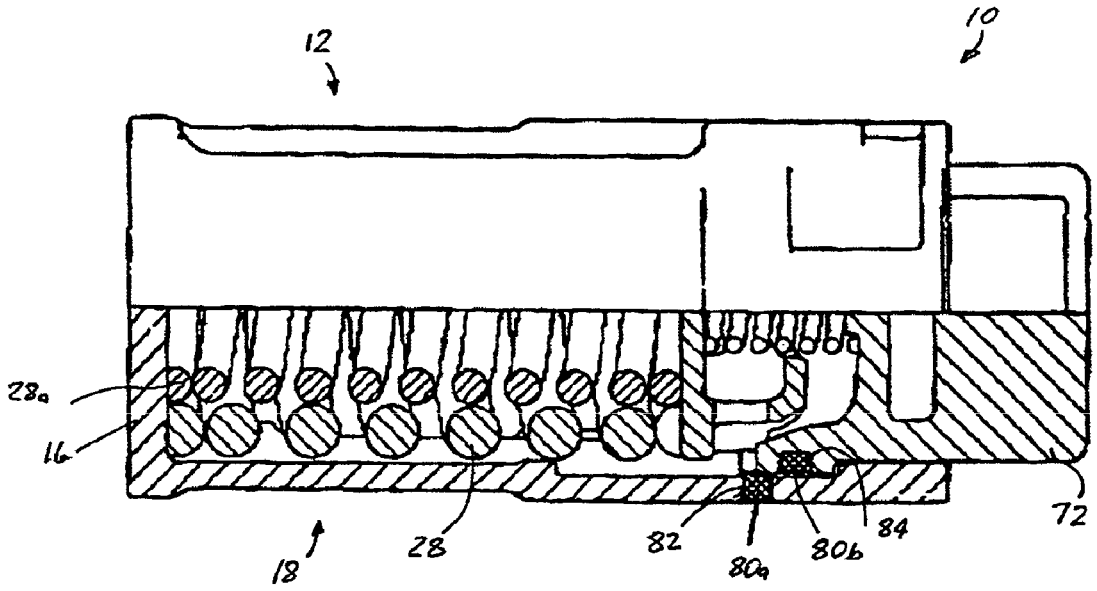
FIG. 2 is a longitudinal partial cross-sectional view taken along the lines 2-2 of FIG. 1, partially showing a draft gear shortening arrangement of the presently preferred embodiment of the invention.

Prior to proceeding to a more detailed description of the friction-type draft gear assembly according to the present invention, it should be noted that identical components having identical functions have been identified with identical reference numerals throughout the several views of the drawings.

Now referring more particularly to the present invention, as illustrated in FIGS. 1-3*c*, the draft gear assembly is generally designated 10. Draft gear assembly 10 absorbs buff and draft shocks that are usually encountered in a railway car during a coupling operation of such railway car to a train consist as well as during normal operation of the train consist on a track structure.

Draft gear assembly 10 includes a housing member, generally designated 12. The housing member 12 is open at a first end thereof and has a rear portion 14 adjacent an end wall 16 which closes the axially-opposed other end of housing member 12. Rear portion 14 is provided for centrally receiving therein a compressible cushioning means, generally designated 18. Housing member 12 includes a front portion 20 adjacent the open end which is in open communication with the rear portion 14 and is provided with a pair of laterally spaced and axially opposed inner friction surfaces 21, which have a Brinell hardness of between about 361 and 444 throughout that was found advantageous in at least reducing wear of the inner friction surfaces 21 and increasing overall life of the housing member 12. The housing member 12 has a critical predetermined length of between about 19.0 inches and about 19.25 inches. Preferably, such length of the housing member 12 will be 19.125 inches.

The compressible cushioning element 18 has one end thereof abutting at least a portion of an inner surface 22 of the bottom wall 16 of housing member 12. The compressible cushioning element 18 extends longitudinally from the inner surface 22 of such bottom wall 16 where the axially-opposed opposite end is placed into abutting relationship with at least a portion of one surface 26 of a seat means 24. Seat means 24 is positioned within the housing member 12 for longitudinal movement therein for respectively compressing and releasing the compressible cushioning element 18 during an application of and a release of a force on the draft gear assembly 10.

Figure 3A:
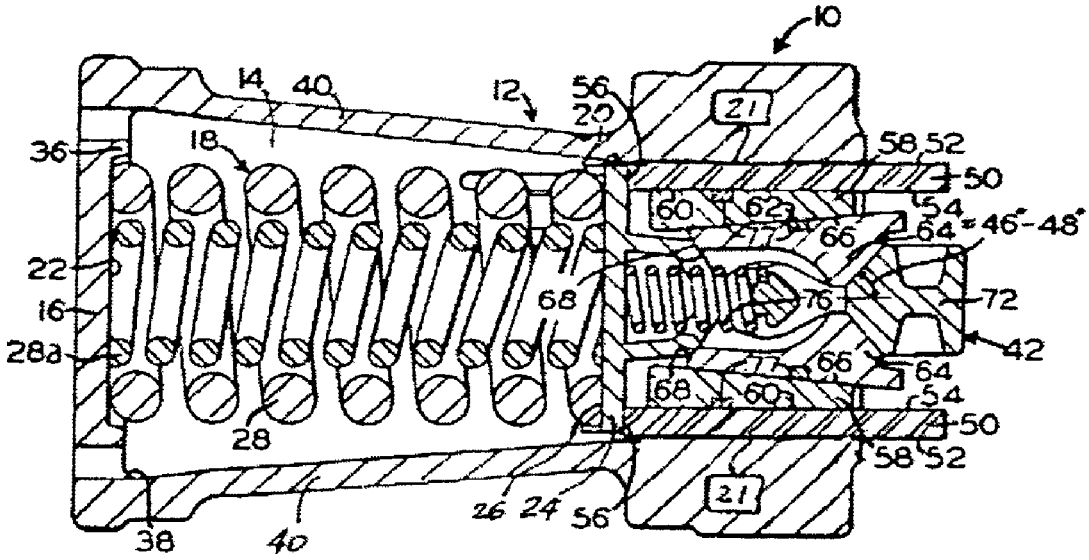
FIG. 3*a* is a longitudinal cross-sectional view taken along the lines 3-3 of FIG. 1 incorporating one form of a presently preferred embodiment of the invented friction-type draft gear assembly.
Figure 3B:
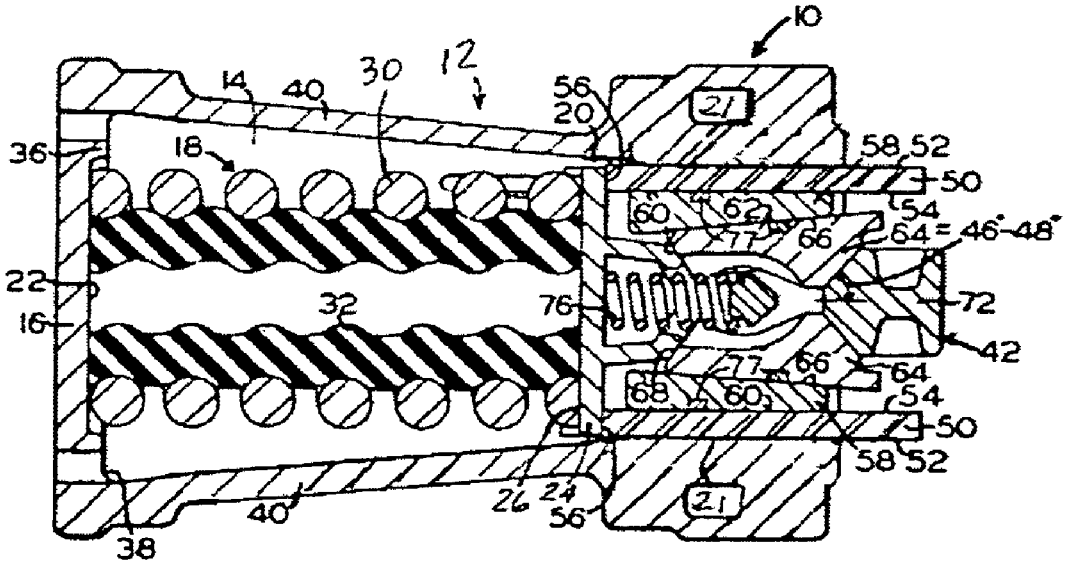
FIG. 3*b* is a longitudinal cross-sectional view taken along the lines 3-3 of FIG. 1 incorporating an alternative embodiment of a compressible cushioning element of another presently preferred embodiment of a friction draft gear assembly according to the present invention.
Figure 3C:
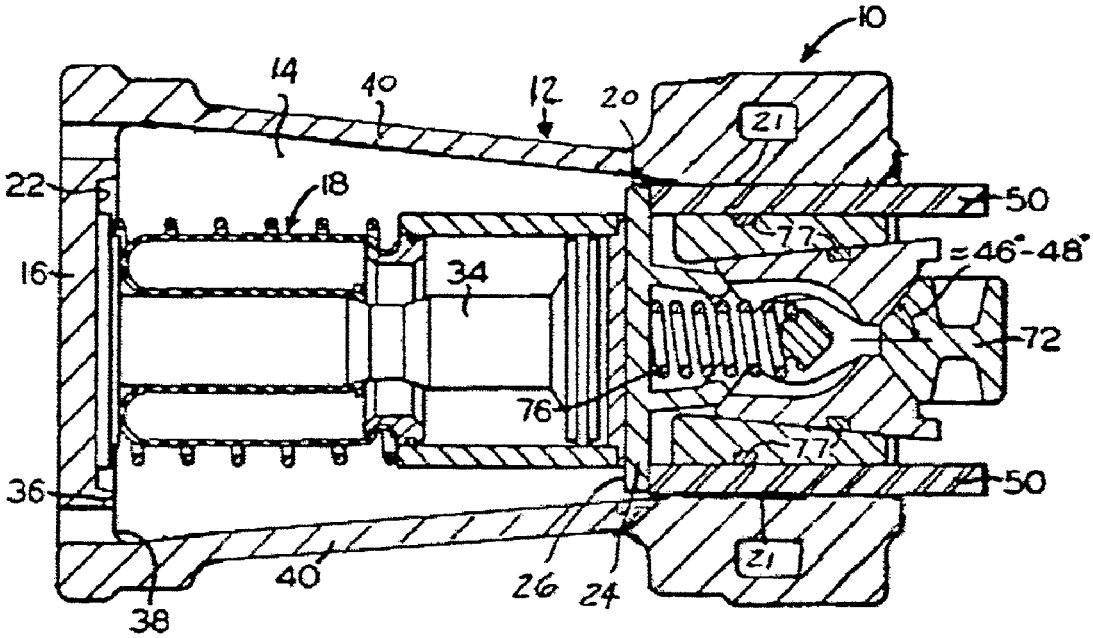
FIG. 3*c* is a longitudinal cross-sectional view taken along the lines 3-3 of FIG. 1 incorporating a hydraulic type cushioning element of another presently preferred embodiment of a friction-type draft gear assembly.

As shown in FIG. 3*a*, compressible cushioning element 18, according to one embodiment of the invention, includes at least one and preferably at least two springs 28 and 28*a*. FIG. 3*b* shows an alternative embodiment for a compressible cushioning element 18 which includes an outer coil spring 30 and an inner spring 32. Spring 32 may be, for example, rubber or an elastomer such as hytrel. FIG. 3*c* shows another alternative embodiment of the invention in which the compressible cushioning element 18 is a hydraulic unit 34 such as taught in U.S. Pat. No. 3,447,693.

The draft gear assembly 10 includes a positioning means 36 disposed adjacent the end of such cushioning element 18 located adjacent the inner surface 22 of the bottom wall 16 of housing member 12 for maintaining that end of the compressible cushioning element 18 centrally located within the rear portion 14 of housing member 12 during compression and extension of such compressible cushioning element 18.

According to one presently preferred embodiment, the positioning means 36 comprises a built-up portion 38 in the housing member 12 along two opposed sides adjacent the inner surface 22 of the bottom wall 16 and an inner surface of a connecting sidewall 40 of housing member 12. The positioning means 36 is preferably formed as an integral part of the housing member 12, i.e., as a single piece casting but alternatively such positioning means 36 may be a separate insert if desired.

Such draft gear assembly 10 further includes a friction cushioning means, generally designated 42, mounted at least partially within the front portion 20 of housing member 12. The friction cushioning means 42 absorbs energy generated during application of a force which is at least sufficient to cause a compression of the draft gear assembly 10.

The friction cushioning means 42 includes a pair of laterally spaced movable plate members 50 of substantially uniform thickness. Movable plate members 50 have an outer friction surface 52 and an inner friction surface 54 and at least one substantially flat edge portion 56 disposed intermediate the outer friction surface 52 and the inner friction surface 54. Such flat edge portion 56 is positioned to engage the seat means 24. At least a portion of the outer friction surface 52 movably and frictionally engages a respective friction surface 21 of the front portion 20 of the housing member 12. Each of such movable plate members 50 has a critical thickness of between about 0.75 inch and about 1.25 inches. The presently preferred thickness of each of such movable plate member 50 is about 1.00 inch. Each of such movable plate members 50 also has a critical length of between about 7.84 inches and about 8.93 inches. In a more preferred embodiment, the length of such movable plate members 50 will be between about 8.25 inches and about 8.65 inches with the most preferred length of such movable plate members 50 being between about 8.34 inches and about 8.44 inches. It is further preferred that material of each of such movable plate member 50 is 8620 carbon steel.

Advantageously, the connecting sidewall 40 of the housing member 12 has been formed in a substantially angular configuration, as best shown in FIGS. 3*a*-3*c*, to provide additional clearance between the inner surface of the housing 12 and the movable plates 50 as compared with prior art draft gear taught in U.S. Pat. No. 5,152,409.

The friction cushioning means 42 includes a pair of laterally spaced tapered plate members 58. The tapered plate members 58 include an outer friction surface 60 and an inner friction surface 62. The outer friction surface 60 movably and frictionally engages at least a portion of the inner friction surface 54 of the movable plate member 50.

Friction cushioning means 42 further includes a pair of laterally spaced wedge shoe members 64 which have at least a portion of an outer friction surface 66 movably and frictionally engaging at least a portion of the inner friction surface 62 of the tapered stationary plate member 58. Wedge shoe members 64 have at least a portion of one edge 68 engaging seat means 24 and a predetermined tapered portion 70 on an opposed edge thereof.

A center wedge 72 is provided which has a pair of matching tapered portions 74 for engaging the tapered portion 70 of the wedge shoe member 64 to initiate frictional engagement of the friction cushioning means 42.

It has been discovered that the tapered portions 70 of the wedge shoe members 64 and the tapered portions 74 of the center wedge member 72 which are tapered upwardly and outwardly from a plane intersecting the longitudinal centerline of the draft gear assembly 10 must be controlled within a very close tolerance of between about 46 degrees and 48 degrees, and preferably between about 46.5 degrees and 47 degrees, with the optimum of about 47 degrees when the compressible cushioning means 18 is either the springs 28 and 28*a* or the combination of a spring 30 and a resilient spring 32. Further, it was discovered that the taper must be about 47 degrees when such compressible cushioning element 18 is a hydraulic unit 34.

In order to meet the AAR-M-901G requirements for a friction-type draft gear assembly 10 it has been found critical that such friction cushioning element 42 further includes at least four lubricating means 77 for lubricating at least four predetermined friction surfaces. Such four friction surfaces are selected from the inner friction surface 54 of the movable plate members 50, the outer friction surface 60 of such tapered plate members 58, the inner friction surface 62 of such tapered plate members 58 and the outer friction surface 66 of such wedge shoe members 64.

Preferably, such lubricating means 77 are graphite inserts 77 contained within a groove formed in selected members of the friction cushioning means 42. Such graphite inserts 77 are illustrated as being in the wedge shoe members 64 and the tapered plate members 58. Although not illustrated, such graphite inserts 77 could be installed on other surfaces. The criticality resides in the fact that four friction surfaces must be lubricated to achieve the required capacity and beneficial aspects of the present invention. The use of graphite inserts 77 improved lubricity and subsequently decreased friction formed intermediate movable friction surfaces causing smoother movement of the friction cushioning element 42 and a reduction of spikes in the reaction force applied to the coupler (not shown) of the railway car (not shown). Such smoother movement enabled achievement of a peak reaction force of less than 500,000 pounds and a collision speed of at least 5 MPH, thus meeting the requirement of AAR-M-901G specification.

A spring release means 76 engages and extends longitudinally between the seat means 24 and the center wedge member 72 for continuously urging the friction cushioning means 42 outwardly from the compressible cushioning means 18 to release the friction cushioning means 42 when an applied force compressing the draft gear assembly 10 is removed.

A draft gear shortening pin 80 is inserted into an aperture 82 provided in a predetermined location of the side wall of the housing member 12 and is further inserted into a complimentary cavity 84 disposed within the center wedge 72 which is aligned with the aperture 82 during assembly of the friction-type draft gear assembly 10. The use of the shortening pin 80 reduces the overall length of the friction-type draft gear assembly 10 and enables ease of installation thereof in the railway vehicle (not shown). In operation, the shortening pin 80 is sheared as best illustrated by reference numerals 80*a* and 80*b* in FIG. 2.

In operation, the buffing shock is transmitted from the coupler through the front follower to the center wedge member 72, causing it to act through the wedge shoe members 64 and thereby compress all of the cushioning elements simultaneously. These parts will furnish sufficient cushioning for light buffing shocks. After suitable travel, however, the follower will come against the outer ends of the movable plate members 50 introducing energy-absorbing friction between the movable plate members 50 and the inners friction surfaces 21 of the front portion 20 of the housing member 12. As this action continues, the pressure between the adjacent surfaces of the movable plate members 50 and front portion 20 of the housing member 12 has been enormously increased due to the fact that the wedge shoe members 64 are loaded against the cushioning mechanism 42. The energy absorption and dissipation through friction and compression of the cushioning mechanism 42 continues until the draft gear assembly 10 is closed including compression of cushioning element 18.

During release of the draft gear assembly 10, the compressible cushioning element 18 is maintained in alignment by the seat means 24.

Although the preferred and various alternative embodiments have been shown and described above, it will be obvious to those persons who are skilled in the railroad draft gear design art that various other modifications and adaptations of the present invention can be made without departing from the spirit of the invention and the scope of the attached claims.

We claim:

1. A railway car friction-type draft gear assembly which enables the cushioning of buff and draft shocks that are usually encountered in such railway car rolling stock during a coupling operation of such railway car to a train consist and during normal operation of such train consist on a track structure, said draft gear assembly comprising:

(a) a housing member closed at a first end thereof by an end wall and open at an axially-opposed second end thereof, said housing member having a rear portion adjacent said first end and a front portion adjacent said axially-opposed second end and being in open communication with said rear portion, said front portion having a pair of laterally spaced and axially opposed inner friction surfaces, said pair of inner friction surfaces having a predetermined Brinell hardness, said housing member having a predetermined length;

(b) a compressible cushioning element centrally disposed within said rear portion of said housing member, one end of said cushioning element abutting at least a portion of an inner surface of said end wall closing said first end of said housing member, said compressible cushioning element extending longitudinally from said inner surface of said end wall;

(c) a positioning means adjacent said inner surface of said end wall at said first end of said housing member for centrally maintaining said one end of said compressible cushioning element in said rear portion of said housing member during compression and extension of said compressible cushioning element;

(d) a seat means having at least a portion of one surface thereof abutting an axially-opposite end of said compressible cushioning element and mounted to move longitudinally within said housing member for respectively compressing and releasing said compressible cushioning element during application and release of a force exerted on said draft gear assembly;

(e) a friction cushioning means positioned at least partially within said front portion of said housing member for absorbing energy during a compression of said draft gear assembly, said friction cushioning means including:

(i) a pair of laterally spaced movable plate members of substantially uniform thickness each having an outer friction surface and an inner friction surface and at least one substantially flat edge intermediate said outer friction surface and said inner friction surface, said one edge engaging said seat means, at least a portion of said outer friction surface movably and frictionally engaging a respective inner friction surface of said front portion of said housing member, each of said movable plate members having a length of between about 7.84 inches and 8.93 inches, (ii) a pair of laterally spaced tapered plate members having an outer friction surface and an inner friction surface, said outer friction surface of each said tapered plate member movably and frictionally engaging at least a portion of said inner friction surface of a respective one of said movable plate members, (iii) a pair of laterally spaced wedge shoe members having an outer friction surface, a bottom edge and an opposed edge, at least a portion of said outer friction surface movably and frictionally engaging at least a portion of said inner friction surface of a respective one of said tapered plate members, and at least a portion of said bottom edge engaging said seat means, said pair of wedge shoe members having a predetermined tapered portion on said opposed edge thereof, (iv) a center wedge member having a pair of matching predetermined tapered portions for engaging said tapered portion of a respective one of said wedge shoe members to initiate frictional engagement of said friction cushioning means and thereby absorb energy, and (v) four lubricating means for lubricating at least four predetermined friction surfaces selected from said inner friction surface of said movable plate members, said outer friction surface of said tapered plate members, said inner friction surface of said tapered plate members and said outer friction surface of said wedge shoe members, and (f) a spring release means engaging and longitudinally extending between said seat means and said center wedge member for continuously urging said friction cushioning means outwardly from said compressible cushioning means to release said friction cushioning element when an applied force compressing said draft gear assembly is removed.

2. The draft gear assembly, according to claim 1, wherein said compressible cushioning element comprises at least one spring.

3. The draft gear assembly, according to claim 2, wherein said compressible cushioning element further comprises a plurality of springs.

4. The draft gear assembly, according to claim 2, wherein said compressible cushioning element further comprises a resilient spring disposed within said at least one spring.

5. The draft gear assembly, according to claim 1, wherein said compressible cushioning element comprises a hydraulic cylinder.

6. The draft gear assembly, according to claim 1, wherein said housing further comprises a built-up portion along two opposed sides adjacent said inner surface of said closed end and an inner surface of a connecting sidewall of said housing for positioning said one end of said compressible cushioning element.

7. The draft gear assembly, according to claim 6, wherein said connecting sidewall is formed in a substantially angular configuration.

8. The draft gear assembly, according to claim 1, wherein said predetermined Brinell hardness of said pair of inner friction surfaces of said front portion of said housing member is between about 361 and 444 throughout.

9. The draft gear assembly, according to claim 1, wherein said draft gear assembly includes a shortening member inserted during an assembly process into an aperture disposed in a predetermined location within a sidewall of said housing member and further inserted into a complimentary cavity disposed within said center wedge and aligned with said aperture during such assembly process, said shortening member is sheared during an initial operation of said draft gear assembly.

10. A draft gear assembly, according to claim 1, wherein said predetermined length of said housing member is between about 19.0 inches and about 19.25 inches.

11. A draft gear assembly, according to claim 10, wherein said length of said movable plate members is between about 8.25 inches and 8.65 inches.

12. A draft gear assembly, according to claim 11, wherein said length of said movable plate members is between about 8.34 inches and about 8.44 inches.

13. The draft gear assembly, according to claim 1, wherein a thickness of said movable plate members is between about 0.75 inches and about 1.25 inches.

14. The draft gear assembly, according to claim 1, wherein each of said movable plate members is produced from 8620 carbonized steel.

15. The draft gear assembly, according to claim 1, wherein said lubrication means is a graphite insert.

16. The draft gear assembly, according to claim 15, wherein said inner friction surface of each said movable plate member is lubricated.

17. The draft gear assembly, according to claim 15, wherein said inner friction surface of each said tapered plate member is lubricated.

18. A draft gear assembly, according to claim 1, wherein said tapered portion of said pair of wedge shoes and said pair of tapered portions of said center wedge are tapered upwardly and outwardly from a plane intersecting the longitudinal centerline of said draft gear assembly at an angle of between 46 degrees and 48 degrees.

19. A draft gear assembly, according to claim 18, wherein said tapered portions are tapered at an angle of between 46.5 degrees and 47 degrees.

20. A draft gear assembly, according to claim 19, wherein said tapered portions are tapered at an angle of generally 47 degrees.

* * * * *